US008847049B2

(12) United States Patent
Han

(10) Patent No.: US 8,847,049 B2
(45) Date of Patent: Sep. 30, 2014

(54) VIBRATION PLATE FOR MUSIC BOX AND PREPARATION METHOD THEREOF

(76) Inventor: Gyu Lak Han, Yongin-si (KR)

( * ) Notice: Subject to any disclaimer, the term of this patent is extended or adjusted under 35 U.S.C. 154(b) by 0 days.

(21) Appl. No.: 13/820,512

(22) PCT Filed: Feb. 9, 2012

(86) PCT No.: PCT/KR2012/000976

§ 371 (c)(1),
(2), (4) Date: Mar. 3, 2013

(87) PCT Pub. No.: WO2012/111940

PCT Pub. Date: Aug. 23, 2012

(65) Prior Publication Data

US 2013/0312583 A1 Nov. 28, 2013

(30) Foreign Application Priority Data

Feb. 18, 2011 (KR) ..... 10-2011-0014364

(51) Int. Cl.
*G10F 5/00* (2006.01)
*G10F 1/06* (2006.01)
*G10F 5/04* (2006.01)

(52) U.S. Cl.
CPC ... *G10F 5/04* (2013.01); *G10F 1/06* (2013.01)
USPC ..... 84/115

(58) Field of Classification Search
USPC ..... 84/94.1, 94.2, 95.2, 95.1, 96–101, 115
See application file for complete search history.

(56) References Cited

U.S. PATENT DOCUMENTS

2004/0065184 A1* 4/2004 Isaka et al. ..... 84/94.1
2006/0169122 A1* 8/2006 Meng-Suen ..... 84/94.1

FOREIGN PATENT DOCUMENTS

JP 07230270 A * 8/1995 ..... 84/94.1
JP 11352955 A * 12/1999 ..... 84/94.1
JP 2002-116753 4/2002
JP 2002-156968 5/2002
JP 2006-003386 1/2006

OTHER PUBLICATIONS

International Search Report of International Application No. PCT/KR2012/000976, dated Sep. 3, 2012.

* cited by examiner

*Primary Examiner* — Kimberly Lockett
(74) *Attorney, Agent, or Firm* — Kile Park Reed & Houtteman PLLC

(57) ABSTRACT

The present invention is an music box vibration plate and the preparation method thereof, which comprises of a plurality of vibration piece disposed in parallel and having a thin flat sound generation pin with different length and generating sound as it is hit by the protrusion of the cylindrical drum or the disc and a fixing portions formed at the base end of the sound generation pin and having an enlarged thickness with the shape of plate, and a plurality of spacers disposed between each fixing portions of the vibration pieces to separate the vibration pieces, and a clamping member to clamp the fixing portions and the spacers.

4 Claims, 5 Drawing Sheets

(a)

(b)

(c)

VIBRATION PLATE FOR MUSIC BOX AND PREPARATION METHOD THEREOF

TECHNICAL FIELD

The present invention relates to a vibration plate for music box and the preparation method thereof, and more particularly to a vibration plate for music box being able to achieve a precise sound scale so as to play music with the precise sound scale and the preparation method thereof.

BACKGROUND ART

Usually, a music box, or an orgel is referred to an automatically played music instrument toy and is applied to clock, finger ring, neck lace, toy and so on. There are two types of music box, the first type music box comprises a disc having a plurality of protrusions cut and bent with predetermined pattern on one side and a metal bar traversing the surface of the disc and having a plurality of pins extending downward against the disc. When the disc turns, the protrusions of the disc hit the pins of the metal bar to generate the sound.

The second type music box comprises, as the basic parts, a rotating cylindrical drum 1 and a metal vibration plate 3 disposed at the side of the cylindrical drum 1 as shown in FIG. 1. The cylindrical drum 1 has a plurality of protrusions 2 with the predetermined pattern on the circumferential surface of it, and the vibration plate 3 has a plurality of sound generation pins 5 with the different lengths corresponding to the different sounds of scale. When the protrusions 2 hit the sound generation pins 5 of the vibration plate 3, the sound generation pins 5 may vibrate and generate the corresponding sounds.

To make the vibration plate 3 having the sound generation pins 5, the metal plate should go through the slit-cutting process to form the sound generation pins 5 with different length. To do this, the metal plate should be machined for the sound generation pins 5 to be formed on the base 4 of the vibration plate 3 in parallel. And the metal plate should be machined for the thickness of the sound generation pins 5 to be thinner than that of the base 4, and the lengths of the sound generation pins 5 to be different from each other corresponding to the sound scale.

The sound generation pin 5 has a natural frequency according to the length of it, and a little difference of the length may result in the difference of the sound. In general, in consideration of the convenience of machining and productivity, the front end of the base 4 of the vibration plate 3 is machined to form an inclined line. But, this process of machining could not achieve precise dimension of the sound generation pins 5 because the lengths of them are machined in one time. So the vibration plate 3 of the conventional music box could not achieve precise sound scale.

DISCLOSURE

Technical Problem

In order to solve the above-mentioned problems of conventional art, it is an object of the present invention to provide a music box vibration plate being able to achieve a precise sound scale so as to play music with the precise sound scale and the preparation method thereof.

Technical Solution

To attain the above object of the present invention, according to an aspect of the present invention, there is provided a vibration plate for music box which is disposed adjacent to a cylindrical drum having a plurality of protrusions and generating sound by hit of the protrusions of the cylindrical drum, wherein the vibration plate comprises a plurality of vibration pieces disposed in parallel and having a thin flat sound generation pin with different length and a fixing portion formed at the base end of the sound generation pin and having an enlarged thickness with the shape of plate, and a plurality of spacer disposed between each fixing portions of the vibration pieces to separate the vibration pieces, and a clamping member to clamp the fixing portions of the vibration pieces and the spacers.

According to another aspect of the present invention, there is provided a vibration plate for a music box, wherein the clamping member comprises a tie rod, and the fixing portions of the vibration pieces and the spacers having holes aligned with each other, through which the tie rod passes.

According to still another aspect of the present invention, there is provided a vibration plate for a music box, wherein the clamping member comprises a clamping block on which the spacers are formed in a body, and the fixing portions of the vibration pieces are inserted between the spacers.

According to another aspect of the present invention, there is provided a preparation method of a vibration plate for music box disposed adjacent to a cylindrical drum having a plurality of protrusions and generating sound by hit of the protrusions of the cylindrical drum 1, wherein the method comprises of;

making the vibration piece having a thin flat sound generation pin and a fixing portions formed at the base end of the sound generation pin and having an enlarged thickness with the shape of plate by partially cutting the stack of a plurality of metal bars;

choosing a set of vibration piece having the sound generation pin with different length and arranging them to form the sound scale and inserting the spacers between the fixing portions of the vibration piece; and clamping all the fixing portions of the vibration pieces and the spacers by use of a clamping member.

Advantageous Effects

According to the present invention, by making the vibration piece 20 having the sound generation pin 21 with different length separately and assembling them, the sound generation pin 21 with the accurately same dimension and the same natural frequency can be obtained at the same time, so the dimension of the sound generation pin 21 such as the length and the thickness can be machined more precisely to achieve more precise sound scale compared to the conventional vibration plates of music box in which the sound generation pins are formed by slitting the metal plate and cutting in different length at once, so the machining process is complicate and low in precision degree.

And according to the present invention, by making the vibration piece 20 having a thin flat sound generation pin 21 and a fixing portions 22 formed at the base end of the sound generation pin 21 and having an enlarged thickness with the shape of plate by partially cutting the stack of a plurality of metal bars; a lot of vibration bar 20 could be machined to have the same dimension at the same time to achieve a precise sound scale and high productivity.

DESCRIPTION OF THE DRAWINGS

The above and other objects and advantages of the invention will become more apparent by describing a preferred embodiment with reference to the accompanying drawings in which.

BEST MODE

Hereinbelow, the preferred embodiments of the invention will be described with reference to the accompanying drawings.

Figure 1:
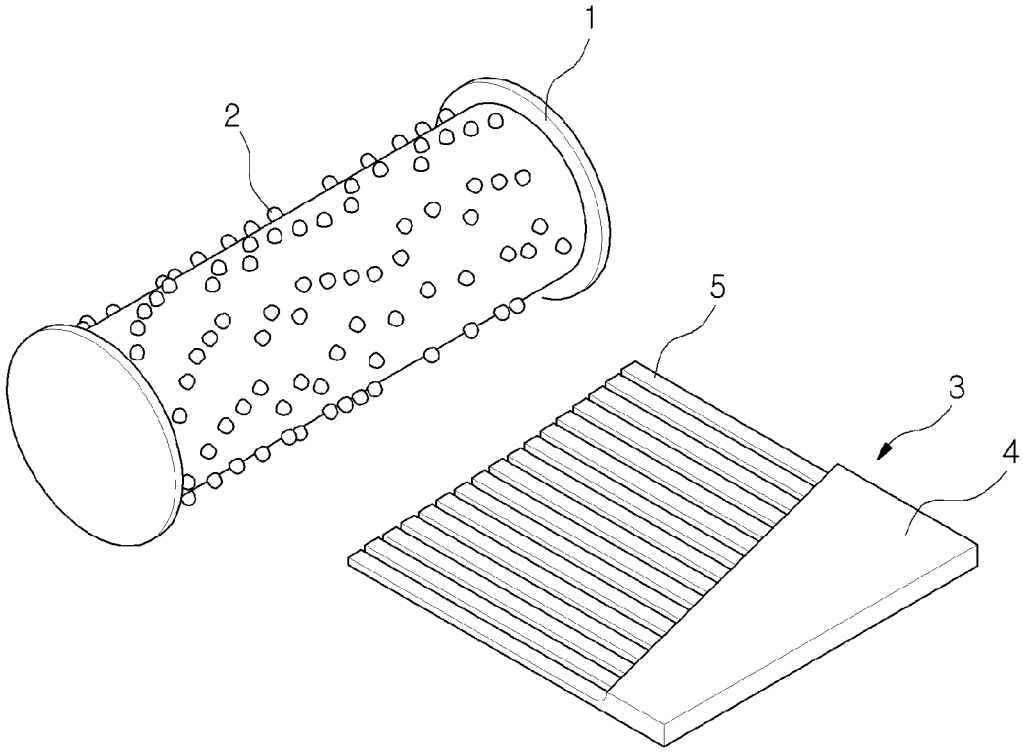
FIG. 1 is a schematic view of the conventional vibration plate of music box.
Figure 2:
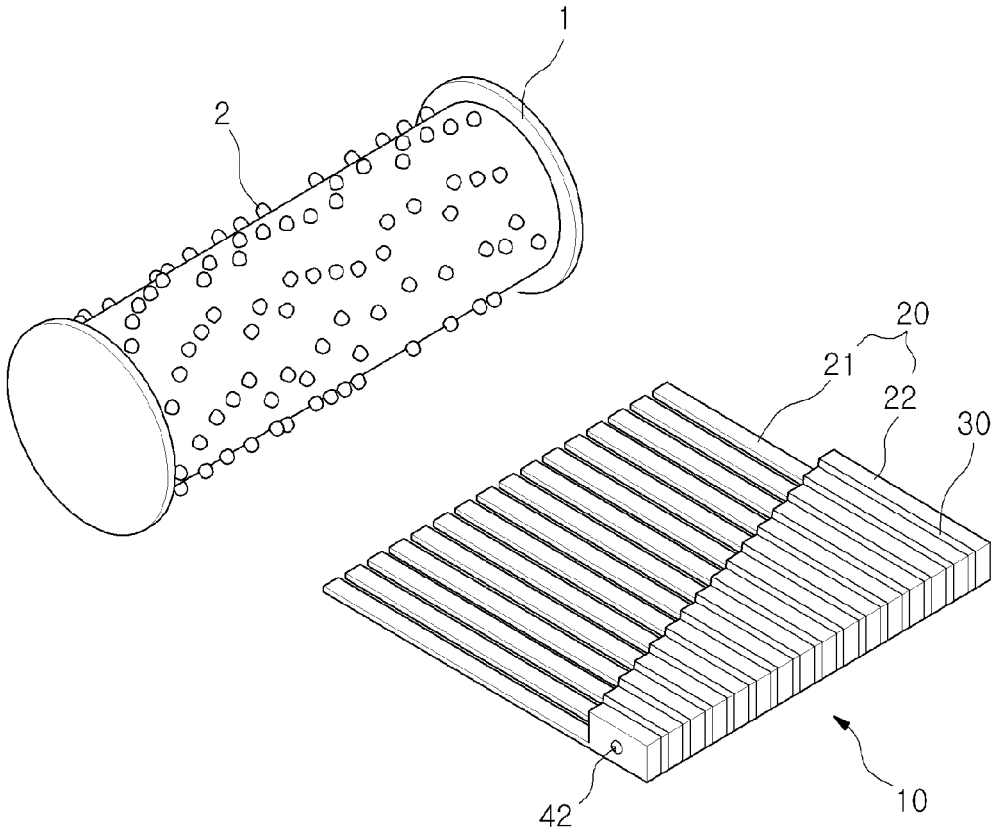
FIG. 2 is a perspective view of an embodiment of the vibration plate of music box according to the present invention.
Figure 3:
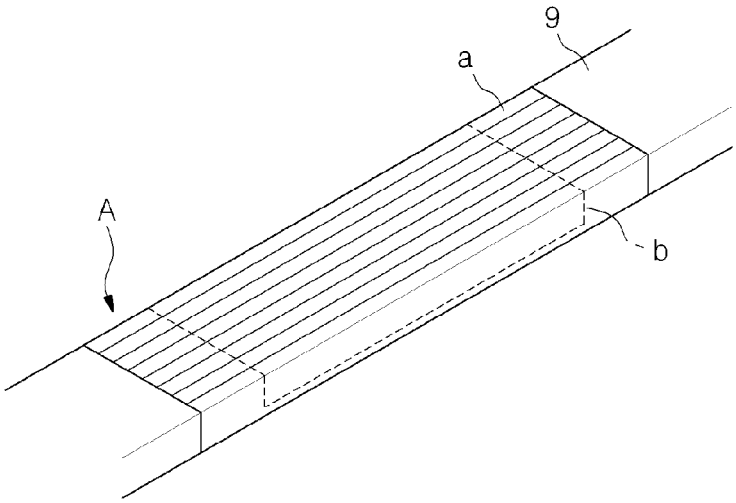
FIG. 3 and FIG. 4 are the views showing the process of the method of the invention.
Figure 3:
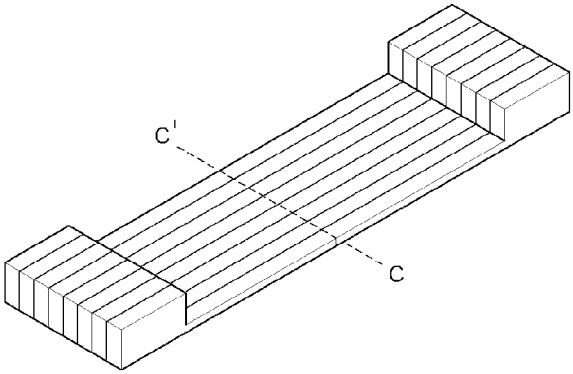
Figure 3:
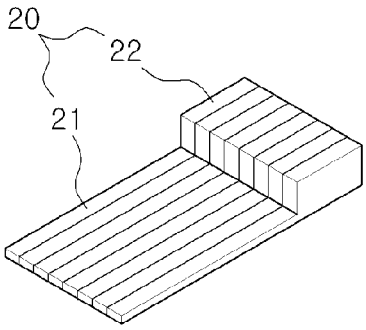
Figure 4:
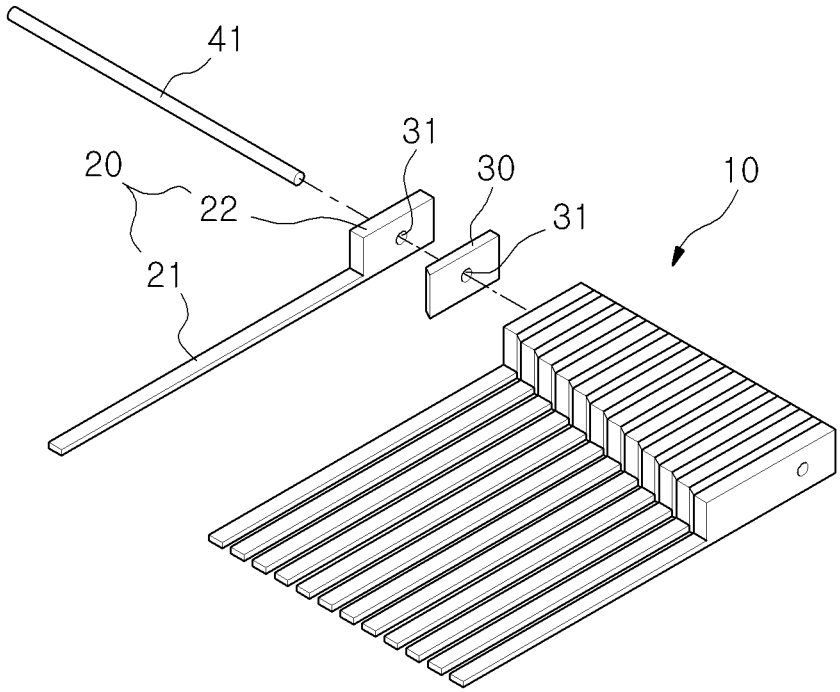

Referring to FIG. 2, FIG. 3 to FIG. 4, a vibration plate 10 for music box of the invention is disposed adjacent to the circumferential surface of the cylindrical drum 1 having a plurality of protrusions on the circumferential surface of it. The vibration plate 10 comprises a plurality of vibration bars 20 disposed in parallel and having a thin flat sound generation pin 21 with different length and generating the sound as it is hit by the protrusions 2 of the cylindrical drum 1 and a fixing portion 22 formed at the base end of the sound generation pin 21 and having an enlarged thickness with the shape of plate, and a plurality of spacers 20 disposed between the fixing portions 22 of the vibration pieces 20 to separate vibration piece 20 to each other, and a clamping member 41, 44 to clamp the fixing portions 22 and the spacers 30 in one body.

Referring FIGS. 3 and 4, the preparation process of the vibration plate for a music box is explained. As shown in FIG. 3A, a plurality of long rectangular metal plates (a) with short vertical length and long horizontal length are stacked to form a metal bar stack (A). The metal bar stack (A) is placed in the frame 9. And the inner part of the metal bar stack (A) is cut according to the cutting line (b) in the shape of rectangular as shown in FIG. 3. Then the lower part of the cutting line (b) is formed as thin and flat. The cutting line (b) may be cut by press, wire cutting, laser cutting, water-jet cutting or other proper cutting means.

Then the resulted metal bar stack (A) is shaped as shown in FIG. 3(*b*). After this, the metal bar stack (A) is cut along the traversing direction of each metal bar (a) at the central part of the cut thin flat portion according the line c-c in FIG. 3(*b*). Then a pair of L shaped metal bar stacks are obtained as shown in FIG. 3(*c*). As a result, a plurality of L shape vibration piece 20 having thin flat sound generation pin 21 formed by cutting and the non-cut fixing portions 22 with the enlarged thickness. As the sound generation pins 21 of the same dimension are machined through the same cutting process, the length and thickness of them are almost the same, so the natural frequencies and the sounds of the sound generation pins 21 are almost same to each other.

If the position of the cutting line (b) is adjusted, different metal bar stacks (A) with the different length of sound generation pin 21 could be obtained. So the vibration pieces 20 having different sound generation pin 21 will generate different sound according to their natural frequencies as they are hit by the protrusions 2 of the cylindrical drum 1. By making a plurality of vibration pieces 20 with the different length of sound generation pin 21 and arranging them according to the length of the sound generation pin 21 in sequence, the sound scale such as Do, Re, Mi will be acquired.

As shown in FIG. 4, the spacers 30 are inserted between the vibration pieces 20 arranged to form a sound scale. The spacer 30 is made to have the same shape and area with those of the fixing portions 22 and, the spacer 30 is placed to contact the fixing portions 22 at the side surface of it. And the fixing portions 22 of the vibration pieces 20 and the spacers 30 are clamped by the clamping member firmly. Usable clamping member may be an adhesive, a tie rod, a clamp or a mounting frame. In this embodiment, a hole 31 is formed on the spacer 30 and the fixing portions 22 of the vibration piece 20, and a tie rod 41 as a clamping member passes through the holes 31 to bind the spacers 30 and the vibration pieces 20 together. The outer end of the tie rod 41 may be fixed by riveting. Instead of tie rod 41, the spacers 30 and the fixing portions 22 of the vibration pieces 20 could be bonded by the adhesive into one body. Or a clamp may be used to clamp the spacers 30 and the fixing portions 22 of the vibration pieces 30. A mounting frame having a recess to receive the spacers 30 and the fixing portions 22 could be used to hold the vibration pieces 30.

Figure 5:
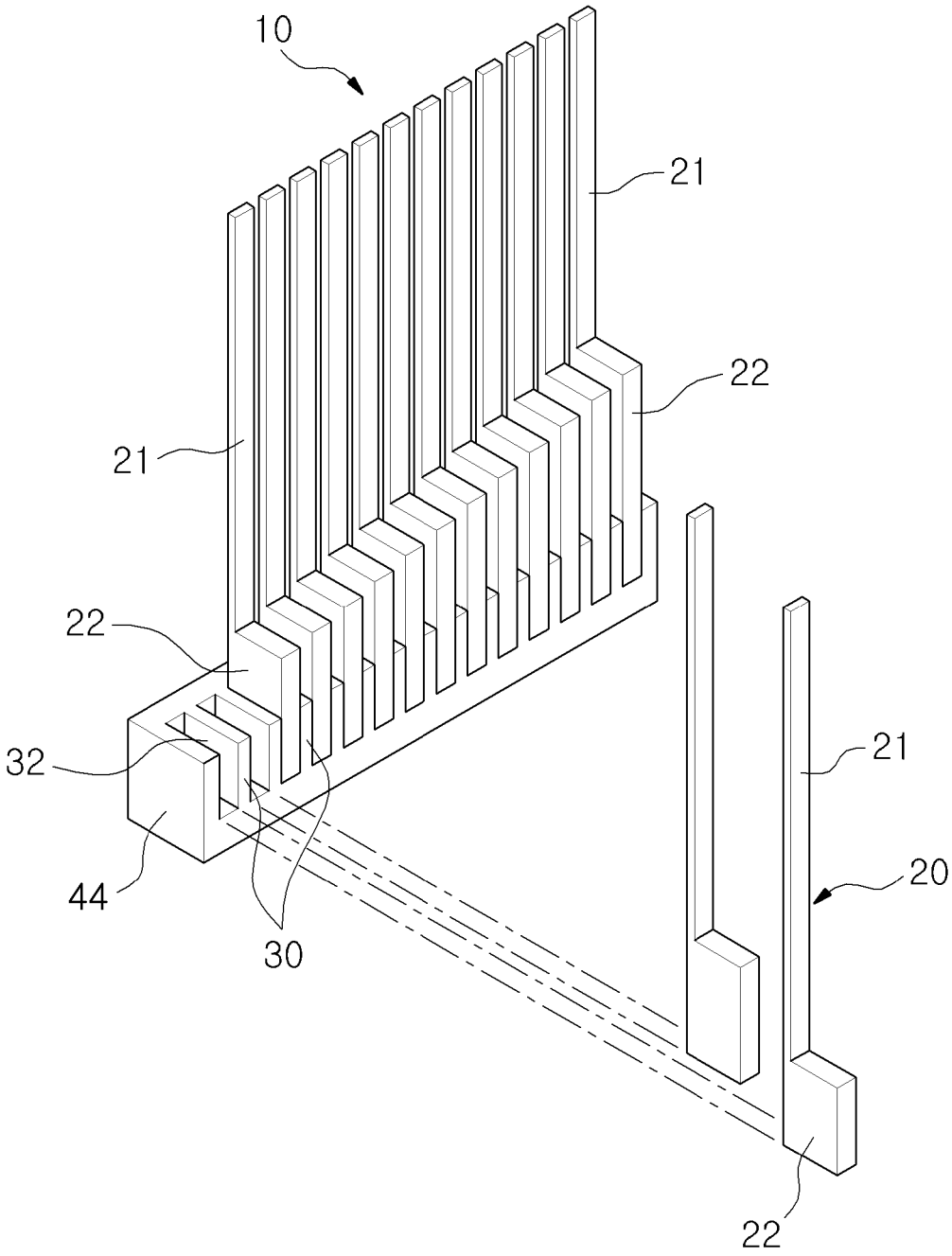
FIG. 5 is a perspective view of another embodiment according to the invention.

FIG. 5 shows another embodiment of the invention, wherein a supporting block 42 having spacers 30 and insert grooves 32 are formed alternately is provided. The supporting block 42 is formed of rigid plastic material, and the fixing portions 22 of the vibration piece 20 are fixed by being inserted into the insert grooves 32 of the supporting block 42. To hold the spacers 30 and the vibration pieces 20 firmly, additional means such as adhesive, bolting or riveting may be used.

According to the invention, by making the vibration piece 20 having the sound generation pin 21 with different length separately amount and assembling them, the sound generation pin 21 with the precisely same dimension and the precisely same natural frequency can be machined and obtained at the same time to achieve more precise sound scale compared to the conventional vibration plates of music box in which the sound generation pins are formed by slitting the metal plate and cutting in different length at once, so the machining process is complicate and low in precision degree.

And according to the invention, by making the vibration piece 20 having a thin flat sound generation pin 21 and a fixing portions 22 formed at the base end of the sound generation pin 21 and having an enlarged thickness with the shape of plate by partially cutting the stack of a plurality of metal bars, a lot of vibration bar 20 could be machined to have the same dimension at the same time to achieve a precise sound scale and high productivity.

As described above, the present invention has been described with respect to particularly preferred embodiments. However, the present invention is not limited to the above embodiments, and it is possible for one who has an ordinary skill in the art to make various modifications and variations, without departing off the spirit of the present invention. For example, though the invention is described to be applied cylindrical drum type music box, it will also be applied to the disc type music box. Thus, the protective scope of the present invention is not defined within the detailed description thereof but is defined by the claims to be described later and the technical spirit of the present invention.

The invention claimed is:

1. A vibration plate for music box disposed adjacent to a cylindrical drum having a plurality of protrusions and generating sound by hit of the protrusions of the cylindrical drum, wherein the vibration plate comprises:

a plurality of vibration pieces disposed in parallel and having a thin flat sound generation pin with different length and a fixing portion formed at the base end of the sound generation pin and having an enlarged thickness with a shape of plate;

a plurality of spacers disposed between each fixing portion of the vibration pieces to separate the vibration pieces; and a clamping member to clamp the fixing portions of the vibration pieces and the spacers.

2. A vibration plate for music box of claim 1, wherein the clamping member comprises a tie rod, wherein the fixing portions of the vibration pieces and the spacers have holes aligned with each other, and the tie rod passes through the holes.

3. A vibration plate for music box of claim 1, wherein the clamping member comprises a clamping block on which the spacers are formed in a body, and the fixing portions of the vibration pieces are inserted between the spacers.

4. A preparation method of an music box vibration plate disposed adjacent to a cylindrical drum having a plurality of protrusions and generating sound by hit of the protrusions of the cylindrical drum, wherein the method comprises:

making a vibration piece having a thin flat sound generation pin and fixing portions formed at a base end of the sound generation pin and having an enlarged thickness with a shape of plate by partially cutting a stack of a plurality of metal bars;

choosing a set of vibration pieces having the sound generation pin with different length and arranging them to form a sound scale and inserting spacers between each fixing portion of the vibration pieces; and clamping all the fixing portions of the vibration pieces and the spacers by use of a clamping member.

* * * * *